United States Patent [19]

Arild

[11] 4,438,978

[45] Mar. 27, 1984

[54] TILT BACK MECHANISM FOR A CHAIR

[76] Inventor: Tor Arild, P.O. Box 4063, Woodside, Calif. 94062

[21] Appl. No.: 322,559

[22] Filed: Nov. 18, 1981

[51] Int. Cl.³ ..... A47C 3/00

[52] U.S. Cl. ..... 297/304; 297/301; 297/302; 248/608

[58] Field of Search ..... 297/301, 302, 303, 304, 297/333; 248/608

[56] References Cited

U.S. PATENT DOCUMENTS

| | | | |
|---|---|---|---|
| 2,718,257 | 9/1955 | Lie | 248/596 X |
| 2,971,569 | 2/1961 | Parrott | 248/608 X |
| 3,360,255 | 12/1967 | Ormond | 267/1 |
| 3,386,770 | 6/1968 | Williams | 297/304 |
| 3,544,159 | 12/1970 | Andersson | 297/303 |
| 3,552,796 | 3/1969 | Williams | 297/304 |
| 3,592,433 | 7/1971 | Fuhrman | 297/304 X |
| 3,598,354 | 8/1971 | Williams | 297/304 X |
| 3,693,925 | 9/1972 | Weinstein | 248/378 |
| 3,788,586 | 1/1974 | McNally | 297/304 X |
| 3,813,073 | 5/1974 | Mohr | 248/608 |
| 4,000,925 | 1/1977 | Doerr | 297/304 |
| 4,328,943 | 5/1982 | Eldon | 297/304 X |

*Primary Examiner*—James T. McCall

*Assistant Examiner*—Peter Brown

*Attorney, Agent, or Firm*—Limbach, Limbach & Sutton

[57] ABSTRACT

The subject invention relates to a tilt back mechanism for resiliently controlling the rearward motion of a chair. More particularly, the subject mechanism includes a planar yoke having upstanding braces formed on the side edges thereof. A rocker plate is received between the braces of the yoke and is pivotally connected thereto enabling the rocker plate to tilt relative to the yoke. A longitudinally extending torsion bar is provided with the front end thereof being fixably mounted adjacent the front end of the rocker plate. The rear end of the torsion bar is supported for rotational movement adjacent the rear end of the rocker plate. A lever arm is fixably connected to the rear end of the torsion bar and extends to one side edge of the yoke in an abutting relationship with a stop member. By this arrangement, the tilting of the rocker plate in the rearward direction causes a rotational torque to be placed on the torsion bar through the rotation of the lever arm such that the tilt back motion is torsionally restricted thereby. In the preferred embodiment of the subject invention, a load arm is provided for pretensioning the torsion bar to facilitate adjustment of the mechanism to conform to the weight of the user.

8 Claims, 3 Drawing Figures

TILT BACK MECHANISM FOR A CHAIR

BACKGROUND OF THE INVENTION

A variety of tilt back mechanisms have been developed for use with chairs. More particularly, mechanisms are known which are interconnected between the seat of a chair and its supporting base, to permit the user to lean and tilt back the seat relative to the ground. The mechanisms are further designed such that the amount of force necessary to tilt the chair rearwardly increases as the angle increases. By this arrangement, the chair is prevented from tipping over backwards when a user leans back too quickly or with too much force. As can be appreciated, due to the forces involved, these mechanisms must be sturdily constructed and reliable. Further, it is preferable that the mechanism be compact and have a low profile such that it does not interfere with the construction of the chair or detract from its aesthetic appearance.

SUMMARY OF THE INVENTION

Accordingly it is an object of the subject invention to provide a new and improved mechanism connectable to a chair for controlling the tilt back motion.

It is a further object of the subject invention to provide a new and improved tilt back mechanism which is compact, and has a low profile, such that it will not detract from the aesthetic appearance of the chair.

It is another object of the subject invention to provide a new and improved tilt back mechanism which is highly reliable, inexpensive to manufacture and durable.

In accordance with these and many other objects, the subject invention consists of a planar yoke having a pair of upstanding braces formed on the opposed side edges thereof. The yoke further includes an upstanding stop means formed on one side edge, adjacent the rear end of the yoke. The tilt back mechanism further includes a rocker plate having a width less than the spacing between the upstanding braces of the yoke, enabling the rocker plate to be received therebetween. The rocker plate is also provided with a pair of upstanding braces disposed to be in alignment with the braces of the yoke. By this arrangement, the adjacent braces of each pair may be pivotally connected enabling the rocker plate to tilt relative to the yoke.

In accordance with the subject invention, a means is provided for restraining the tilting of the rocker plate in the rearward direction. More particularly, the restraining means includes a torsion bar extending longitudinally along the rocker plate from the front to the rear end thereof. The front end of the torsion bar is fixably mounted adjacent the front end of the rocker plate. In addition, the torsion bar is supported for rotational movement adjacent its rear end. The restraining means further includes a lever arm which is fixably connected to the rear end of the torsion bar and extends to and is aligned with the upstanding stop means of the yoke.

In use, when the seat is tilted rearwardly, relative to the base of the chair, the rocker plate tilts in the rearward direction relative to the yoke. This movement places a rotational torque on the torsion bar through the rotation of the lever arm such that the tilt back motion is torsionally restricted thereby. As can be appreciated, as the degree of tilting is increased, the restraining force generated by the torsion bar is increased thereby preventing the seat from tilting backwards too quickly. In the preferred embodiment of the subject invention, a pretensioning means is provided for adjusting the force required to cause initial tilting of the chair. By this arrangement, the characteristics of the tilt back mechanism can be adjusted to conform to the size and weight of the user.

Further objects and advantages of the subject invention will become apparent from the following detailed description taken in conjunction with the drawings in which:

DETAILED DESCRIPTION OF THE PREFERRED EMBODIMENT

Figure 1:
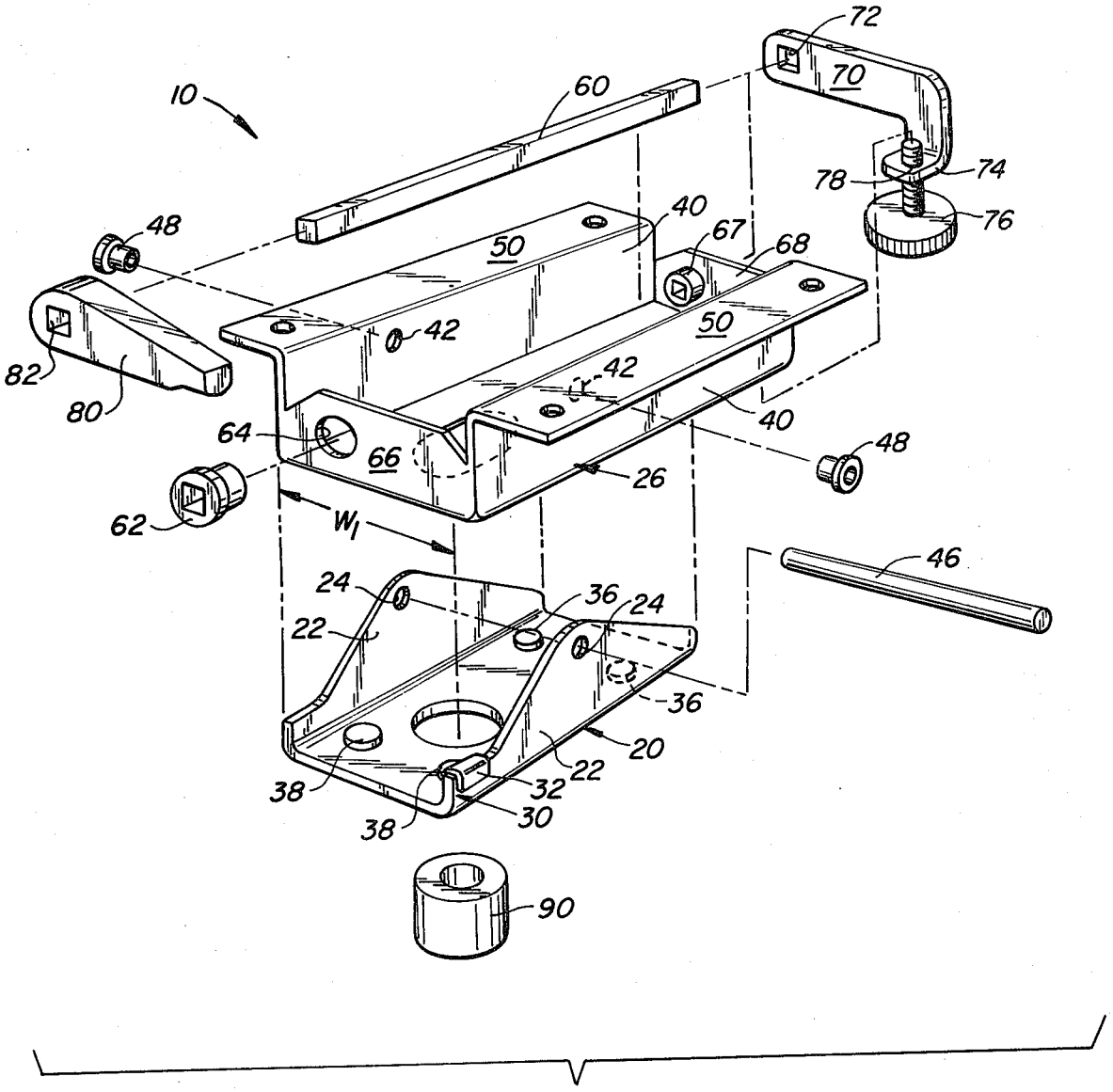
FIG. 1 is an exploded perspective view of the new and improved tilt back mechanism of the subject invention.
Figure 2:
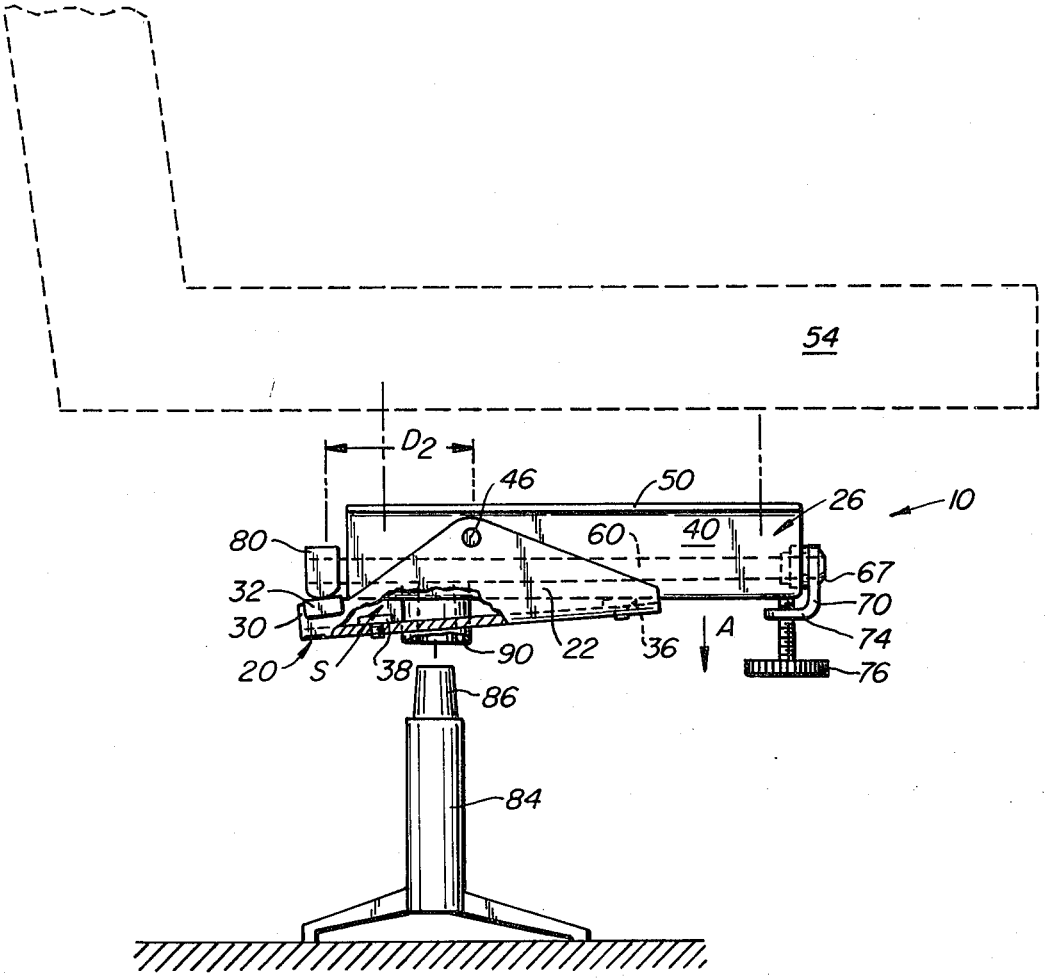
FIG. 2 is a side elevational view of the tilt back mechanism of the subject invention shown in conjunction with a chair.
Figure 3:
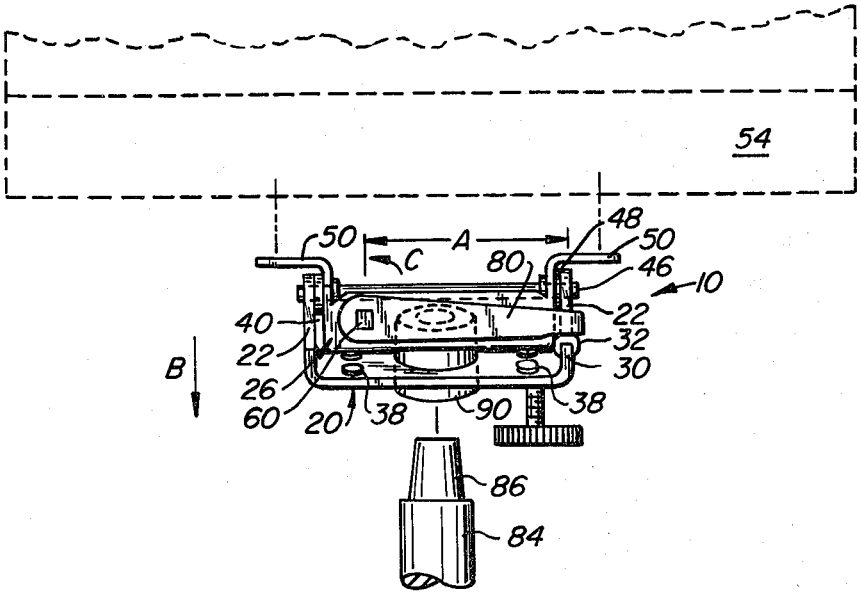
FIG. 3 is a rear elevational view of the tilt back mechanism of the subject invention.

Referring to FIGS. 1–3, the new and improved tilt back mechanism 10 of the subject invention is illustrated. The tilt back mechanism 10 includes a planar yoke 20 having a pair of upstanding braces 22 formed along the side edges thereof. Each brace 22 is provided with an aperature 24 to facilitate the pivotal connection between the yoke 20 and the rocker plate 26. Yoke 20 further includes an upstanding stop means 30, located at one side edge thereof adjacent its rear end. Preferably, a pad 32 is provided on the stop means 30 to reduce the likelihood of its deterioration due to wear. The upper surface of the yoke may also include a plurality of front and rear stop buttons, 36 and 38, respectively. As discussed more fully hereinbelow, the maximum tilting of the mechanism can be controlled by adjusting the height of the stop buttons 36 and 38.

The tilt back mechanism 10 further includes a rocker plate 26 having a width $W_1$, less than the spacing between the opposed braces 24 of yoke 20, enabling the rocker plate to be received therebetween. Rocker plate 26 includes a second pair of upstanding braces 40, formed along the side edges thereof. Each brace 40 includes an aperature 42 disposed to be in alignment with the aperatures 24 of the yoke 20 when the rocker plate is mounted within the yoke. It is intended that the adjacent braces in each pair be pivotally connected to permit the tilting of the rocker plate relative to the yoke. In the preferred embodiment, the pivotal connection is defined by a pivot axel 46, which passes through the aligned aperatures 24 and 42 in braces 22 and 40 respectively. A pair of bushings 48 may be mounted in the apertures 24, 42, to facilitate the pivoting movement. Each brace 40 may further include a flange 50, disposed perpendicularly thereto, to facilitate the connection of the mechanism to the seat 54, as illustrated in FIGS. 2 and 3.

In accordance with the subject invention, a means for restraining the tilting of the mechanism 10, in a rearward direction is provided. More particularly, the restraining means includes a torsion bar 60 extending longitudinally along the rocker plate, from the front to rear end thereof. The torsion bar 60 is mounted in the rocker plate such the rear end thereof is supported for rotational movement. In the preferred embodiment of the subject invention, the rotational mounting is achieved by connecting the rear end of torsion bar 60 to a bearing 62. Bearing 62 is received in an aperature 64 formed in a flange 66 provided at the rear end of the rocker plate.

In accordance with the subject invention, the front end of the torsion bar must be fixably mounted with respect to its rear end to permit the generation of the restraining forces. Accordingly, in the simplest construction, it is merely necessary to fixably connect the front end of torsion bar to the front end of the rocker plate. However, in the preferred embodiment, a means for adjusting the tension initially placed on the torsion bar is provided. Accordingly, the front end of torsion bar 60 is also supported for rotational movement in a manner similar to the rear end. As illustrated in FIG. 1, a bearing 67 can be mounted in the front flange 68 of the rocker plate.

The means for pretensioning the torsion bar 60 includes a load arm 70 which is fixably connected to the front end of the torsion bar. Where the torsion bar is provided with a square cross section, load arm 70 may be provided with a square aperture 72 to facilitate the fixed connection. Load arm 70 further includes a flange 74. As illustrated in FIG. 2, flange 74 projects below the lower surface of the rocker plate 26 in parallel relationship thereto. A screw 76 is threadably engaged in an aperature 78 formed in flange 74. Screw 76 is intended to abut against the lower surface of the rocker plate. By rotating screw 76, the amount of tension placed on torsion bar 60 can be adjusted, as described more fully hereinbelow.

In accordance with the subject invention, the restraining means further includes a lever arm 80 which is fixably connected to the rear end of torsion bar 60. Lever arm 80 may be provided with a square aperature 82 to facilitate the connection to the bar. Lever arm 80 extends away from the torsion bar 60 and is aligned with the stop means 30 of yoke 20. In the preferred embodiment of the subject invention, the distance $D_1$ (FIG. 2) between the connection of the lever arm 80 and stop means 30 is equal to the distance $D_2$ (FIG. 3) between the stop means and the pivotal connection 24 of the adjacent brace. By this arrangement, every degree of relative motion between the rocker plate and the yoke, produces a corresponding amount of rotational movement of the lever arm 80. This correspondence facilitates the calculation of load forces which are imparted to torsion bar 60.

FIGS. 2 and 3 illustrate the tilt back mechanism 10 of the subject invention assembled and connected to chair. A chair typically will include a base or pedestal 84 and a seat portion 54. Base 84 may be provided with an upper conical portion 86. Preferably, the subject mechanism 10 will include a bushing 90, having an inner surface correspondingly tapered to receive conical portion 86 of base 84. Bushing 90 may be welded to the yoke 20. Seat 54 is connectable to rocker plate 26 along flanges 50.

FIGS. 2 and 3 illustrate the seat 54 in the horizontal position. In this condition, the lower surface of rocker plate 20 rests on forward stop buttons 36. The maximum amount of forward tilting can be controlled by regulating the height of stop buttons 36. As illustrated in FIG. 2, a space S exists between the lower surface of rocker plate 26 and the rear stop buttons 38. The maximum amount of rearward tilting of the rocker plate 26 can similarly be controlled by regulating the height of stop buttons 38.

In use, load arm 70 is initially adjusted to pretension torsion bar 60 to conform to the weight of the user. Rotation of screw 76, in a clockwise direction, will force bracket 74 downwardly, as illustrated by arrow A in FIG. 2. The downward movement of bracket 74 causes load arm 70 to rotate in the clockwise direction, as viewed from FIG. 3. The rotation of load arm 70 places a clockwise rotational torque on the front end of torsion bar 60, increasing the tension therein. The greater the weight of the user, the more tension should be placed on the bar such that small movements will not create large tilting motions.

In accordance with the subject invention, mechanism 10 functions to restrain the movement of the seat 54 when the user tilts backwardly. More particularly, as the seat is tilted backwardly, the rear end of rocker plate 26 will move downwardly, as illustrated by Arrow B in FIG. 3. As stated above, the end of lever arm 80 is aligned with and abuts stop means 30, such that the movement of its distal end is arrested. However, the rear end of torsion bar 60 is mounted for rotational movement. Accordingly, as the rear end of rocker plate 26 moves downwardly, a rotational torque will be placed on the rear end of torsion bar 60, in a counter-clockwise direction, as illustrated by Arrow C in FIG. 3. Thus, any tilt back motion is torsionally restricted by bar 60. As the user continues to lean back in the chair, the rocker plate will continue its downward motion until the lower surface thereof abuts rear stop buttons 38.

The amount of torsional restriction of the subject mechanism can be regulated by varying a number of parameters. For example, the strength, rigidity and length of the bar 60 can be adjusted to achieve various levels of torsional restraint. Further, the length of lever arm 80 can be varied to transmit different levels of tension.

In summary there has been provided a new and improved tilt back mechanism for restraining the rearward motion of a chair. More particularly, a tilt back mechanism 10 is disclosed comprising a planar yoke 20 having a pair of upstanding braces 22 formed along the side edges thereof. Yoke 20 further includes a upstanding stop means 30, formed adjacent the rear end, along one side edge thereof. The tilt back mechanism further includes a rocker plate 26 configured to be received between the braces 24 of the yoke. The rocker plate includes a second pair of braces 40 which are aligned with the first braces. The adjacent braces of each pair are pivotally connected enabling the rocker plate to tilt relative to the yoke. In accordance with the subject invention, a means for restraining the tilting of the rocker plate in the rearward direction is provided. More particularly, the restraining means includes a longitudinally extending torsion bar 60, with the front end thereof being fixably mounted adjacent the front end of the rocker plate. The torsion bar is supported for rotational movement adjacent the opposed rear end thereof. The restraining means further includes a lever arm 80 fixably connected to the rear end of the torsion bar. Lever arm 80 extends to and abuts with stop means 30. By this arrangement, the rearward tilting of rocker plate 26 causes a rotational torque to be placed on torsion bar 60, through the rotation of lever arm 80, such that the tilt back motion is torsionally restricted thereby. In the preferred embodiment of the subject invention, a means for pretensioning the torsion bar is provided such that the initial degree of torsional restraint can be adjusted to conform to the weight of the user.

While the subject invention has been described with reference to a preferred embodiment, it is to be understood that various other changes and modifications could be made therein, by one skilled in the art, without varying from the scope and spirit of the subject invention as defined by the appended claims.

I claim:

1. A tilt back mechanism for a chair comprising:

a planar yoke having front and rear ends, said yoke including a pair of upstanding braces formed along the opposed side edges thereof, and with the yoke further including an upstanding stop means formed adjacent the rear end along one side edge thereof;

a rocker plate having front and rear ends and a width less than the spacing between the upstanding braces of the yoke enabling the rocker plate to be received therebetween, and with the rocker plate including a second pair of upstanding braces formed along the side edges thereof, with adjacent braces of each pair being pivotally connected enabling the rocker plate to tilt relative to the yoke; and means for restraining the tilting of the rocker plate in the rearward direction, the restraining means including a torsion bar extending longitudinally along the rocker plate from the front to the rear end thereof, with front end of the torsion bar being fixably mounted adjacent the front end of the rocker plate and with the torsion bar being supported for rotational movement adjacent the opposed rear end thereof, with the restraining means further including a lever arm fixably connected to the rear end of the torsion bar and extending to said one side edge of the yoke in a manner to be aligned and abutting with the upstanding stop means whereby tilting of the rocker plate in the rearward direction causes a rotational torque to be placed on the torsion bar through the rotational movement of the lever arm such that the tilt back motion is torsionally restricted thereby.

2. A tilt back mechanism as recited in claim 1 further including a means for pretensioning the torsion bar.

3. A tilt back mechanism as recited in claim 2 wherein said pretensioning means includes a load arm fixably connected to the front end of the torsion bar and extending towards said one side edge of the yoke where said first stop means is located, and with the torsion bar being supported for rotational movement adjacent the front end thereof, with the free end of the load arm including a flange projecting below and parallel to the surface of the rocker plate, said pretensioning means further including a means for adjusting the position of the load arm in a manner to place a rotational torque on the torsion bar and increase the tension therein.

4. A tilt back mechanism as recited in claim 3 wherein said means for adjusting the position of the load arm is defined by a screw means bearing against the lower surface of the rocker plate, such that rotation of the screw means causes the rotation of the load arm.

5. A tilt back mechanism as recited in claims 1, 2, 3 or 4 further including a plurality of upstanding stop buttons formed on the upper surface of the yoke, said stop buttons for controlling the maximum tilting of the rocker plate relative to the yoke.

6. A tilt back mechanism as recited in claims 1, 2, 3 or 4 wherein the pivotal connection between the braces of the rocker plate and the yoke includes a pivot axle extending between and pivotally connecting said braces.

7. A tilt back mechanism as recited in claim 1 wherein the distance measured between the fixed connection of the lever arm and the first stop means is equal to the distance between the stop means and the pivotal connection of the adjacent brace of the yoke such that every degree of tilting motion of the rocker plate relative to the yoke produces a corresponding amount of rotational motion of the lever arm thereby facilitating calculation of stress requirements.

8. A tilt back mechanism as recited in claim 1 wherein each said second brace of said rocker plate includes a flange extending perpendicularly thereto, said flanges to facilitate the connection of said mechanism to a chair seat.

* * * * *